United States Patent [19]

Pedersen

[11] Patent Number: 4,844,427

[45] Date of Patent: Jul. 4, 1989

[54] QUENCHING APPARATUS

[75] Inventor: Harry Pedersen, Rochester, N.Y.

[73] Assignee: The Gleason Works, Rochester, N.Y.

[21] Appl. No.: 150,969

[22] Filed: Feb. 1, 1988

[51] Int. Cl.[4] ..... C21D 11/00

[52] U.S. Cl. ..... 266/80; 266/87; 266/90; 266/94; 266/114

[58] Field of Search ..... 266/118, 114, 80, 87, 266/90, 99; 148/128; 73/760, 763, 766, 774

[56] References Cited

U.S. PATENT DOCUMENTS

| | | | |
|---|---|---|---|
| 2,494,984 | 1/1950 | Bauer | 266/118 |
| 2,860,077 | 11/1958 | Adair et al. | 266/118 |
| 3,007,823 | 11/1961 | Adair et al. | 266/118 |
| 3,239,202 | 3/1966 | Bauer et al. | 266/118 |
| 3,845,944 | 11/1974 | Miller et al. | 266/118 |
| 4,050,963 | 9/1977 | Kunioka et al. | 148/128 |

OTHER PUBLICATIONS

"The Mechanics of Press Quenching", G. Hewitt, Heat Treatment of Metals, 1974.4, pp. 88 through 91.

"Gleason No. 537 Quenching Machine", Gleason, 1000 University Avenue, Rochester, N.Y. 14692, U.S.A.

Technical Bulletin 1002D, "LVDT and RVDT Linear and Angular Displacement Transducers," Schaevitz Engineering, Pennsauken, N.J., U.S.A.

*Primary Examiner*—Deborah Yee

*Attorney, Agent, or Firm*—Thomas B. Ryan; Ralph E. Harper; Morton A. Polster

[57] ABSTRACT

A method and apparatus for measuring the bulk temperature of a workpiece in a quenching apparatus. The temperature is calculated by monitoring the change in size of the bore in the workpiece.

4 Claims, 6 Drawing Sheets

QUENCHING APPARATUS

The present invention is directed to a quenching apparatus and more particularly to a method and apparatus for measuring the bulk temperature (average interior temperature) of a workpiece in a die quenching apparatus.

Die quenching devices are most frequently used for quenching circular parts that have a generally annular form such as a gear. The quenching dies apply a controlled set of forces to the workpiece, thereby providing a means for controlling flatness, roundness, and bore diameter. Before the workpieces arrive at the quenching machine, they have typically been put through a carburizing process to increase the carbon content in the outer surface. The rapid cooling of the quenching process causes the surface to become hard. This is usually the primary purpose for carburizing and quenching parts. Another purpose is to control the hardness and toughness of the core material.

It has long been desired to monitor the temperature of a workpiece during the quenching process. This would have many benefits, for example; this would enable the operator to adjust the flow rate of the quenching fluid to achieve a prescribed cooling rate in the workpiece and thereby control the hardness and toughness of the core material. This would also enable the operator to determine when the workpiece temperature is below the flash point of the quenching medium. As the workpiece temperature approaches the temperature of the quenching medium, the cooling rate decreases. Therefore, a sizeable portion of the quenching cycle time may be used to reduce the temperature to a value that is close to the quenching medium temperature. If the workpiece can be air cooled outside the apparatus without danger to the operator, the machine cycle can be terminated early, thereby improving the productivity of the machine. It is also desirable to know the initial temperature of the workpiece to assure that the appropriate material properties can be achieved in the workpiece. However, at the present time there is no known temperature sensing device that can act on the workpiece while it is in the quenching chamber of the apparatus.

Applicants have intended a method and apparatus wherein the bulk temperature of the workpiece can be determined when the workpiece is initially placed in the apparatus and also during the quenching cycle.

SUMMARY OF THE PRESENT INVENTION

In one aspect of the invention, there is provided an apparatus for quenching a workpiece having a substantially circular central bore for measuring the bulk temperature of a workpiece placed therein. The apparatus includes means for supporting and holding the workpiece in place. Means for measuring the temperature of the workpiece during quenching in response to the size of the bore is provided.

In another aspect of the present invention, there is provided a method for measuring the temperature during quenching of a workpiece having a substantially central bore, the method comprising the steps of;

monitoring a change in size of the bore during quenching;

calculating the temperature of the workpiece in response to the change in bore diameter being monitored.

DETAILED DESCRIPTION OF THE INVENTION

Figure 1:
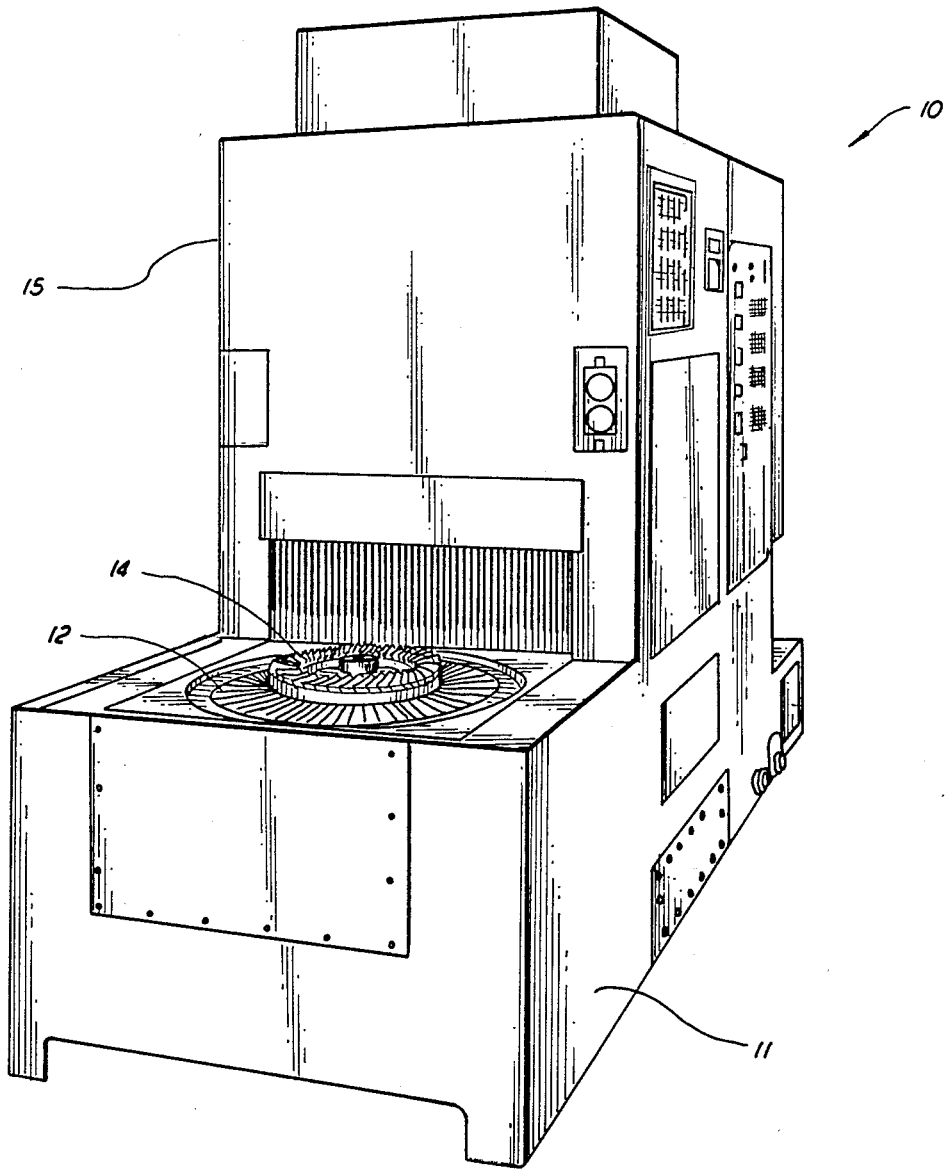
FIG. 1 is perspective view of a quenching apparatus made in accordance with the present invention.

Referring to FIG. 1 there is illustrated a quenching apparatus 10 made in accordance with the present invention. The general construction and operation of the quenching apparatus 10 is typical of prior art devices; an example of which is illustrated by a quenching machine made by The Gleason Works, Gleason No. 537. The apparatus 10 comprises a base section 11 having support table 12 slideably mounted thereon for supporting an annular workpiece 14. The apparatus 10 is further provided with a column section 15 in which the support table 12 is placed during the quenching process. The workpiece 14 in the particular embodiment illustrated comprises a gear having a substantially circular central bore 16.

Figure 2:
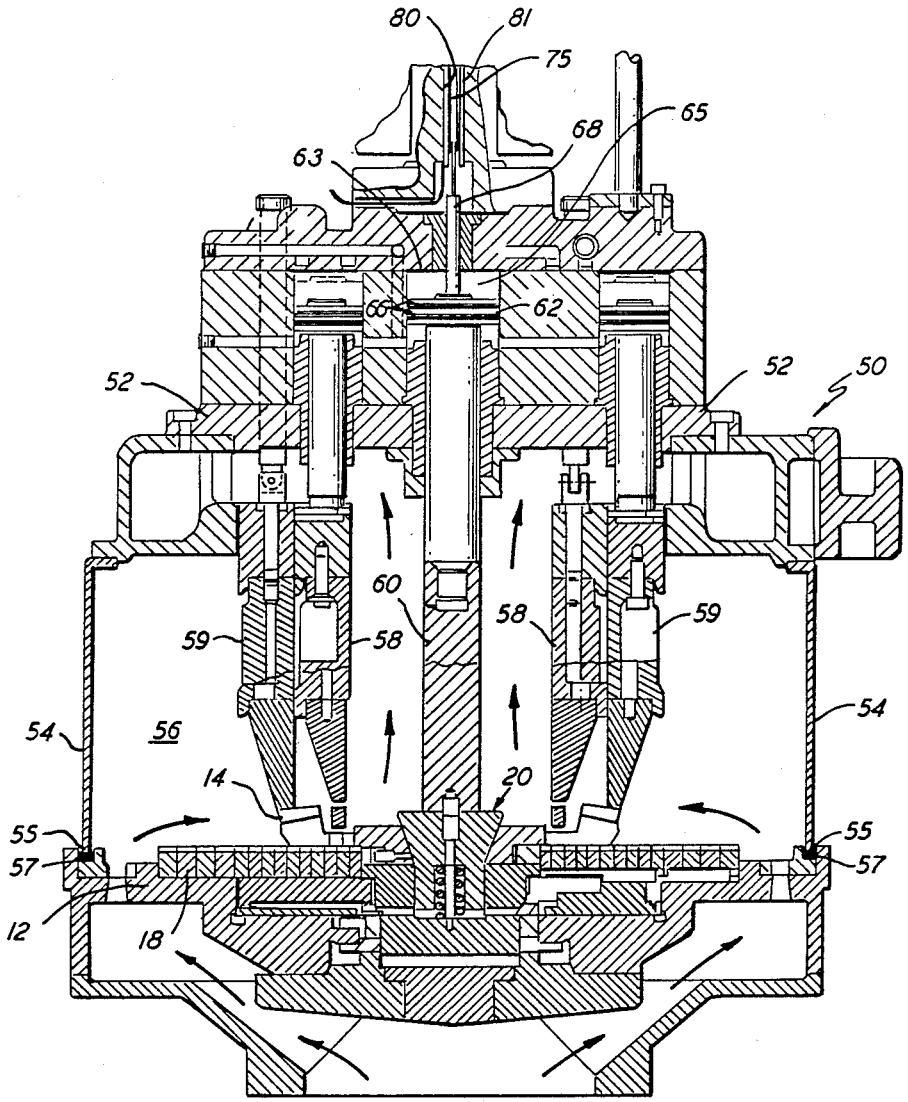
FIG. 2 is a cross sectional view of a portion of the quenching apparatus of FIG. 1 with a workpiece in position thereon.
Figure 3:
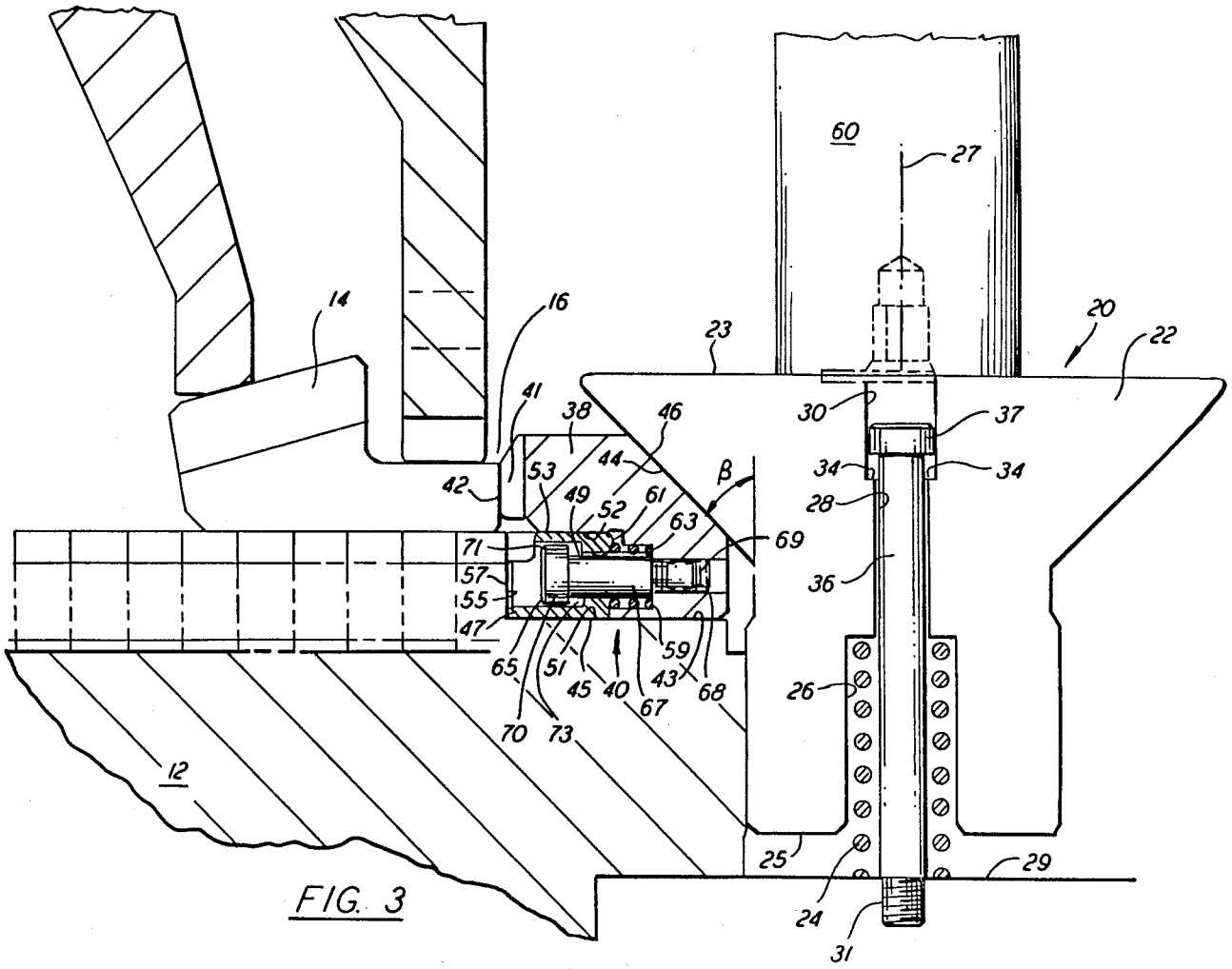
FIG. 3 is an enlarged cross section view of a portion of FIG. 2 illustrating the mating relationships between the workpiece, expander assembly and ram.
Figure 4:
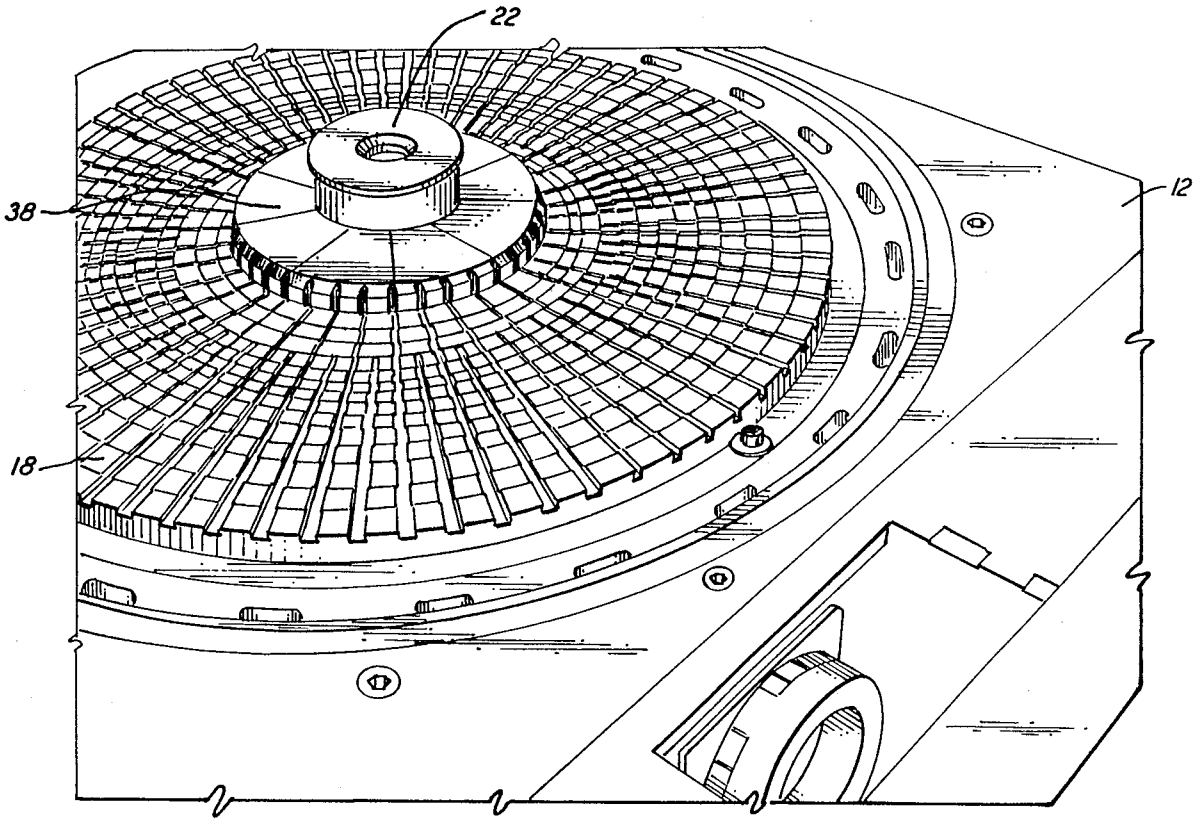
FIG. 4 is a perspective view of the support table of the apparatus of FIG. 1 with the workpiece removed illustrating the expander assembly.

Referring to FIGS. 2, 3 and 4, the support table 12 comprises an annular lower die 18 for supporting the workpiece 14. The support table 12 is further provided with an expander assembly 20 for holding in position the workpiece 14 and which is capable of transmitting a force against the bore 16. The expander assembly 20 comprises a central cone 22 having a top surface 23, an annular mating surface 46 and a bottom surface 25. The cone 22 has bore 26 which extends from bottom surface 25 along the vertical axis 27 of the cone 22. Cone 22 is biased upwards by a spring 24 located within bore 26 which rests on surface 29 on table 12. Cone 22 is further provided with a recess 30 extending from top surface 23 and bore 28 which connects recess 30 with bore 26. Recess 30 is larger than bore 26 so as to provide an annular shoulder 34. An aligning pin 36 extends through recess 30, bore 28, bore 26 and spring 24 and is secured to support table 12 by threads 31. While in the embodiment illustrated pin 36 is threaded in table 12 the pin 36 may be secured to the table 12 by any desired means. The guide pin 36 has a head portion 37 which fits in annular recess portion 30. The head is larger in diameter than bore 28 such that it stops cone 22 from further vertical movement when it abutts annular shoulder 34 of cone 22. The expander assembly 20 is further provided with a plurality of annular segments 38 each having a lower support surface 43 which is slideably supported by support surface 45 of support tables 12. The annular segments 38 are biased radially inward toward cone 22 by bias means 40. In the particular embodiment illustrated, nine annular segments 38 are provided. However, it is understood that any desired number of segments 38 may be provided. Each angular segment 38 has an outer peripheral annular surface 41 which mates with the inner surface 42 of the bore 16 of workpiece 14. Annular segments 38 are each provided with a inner mating surface 44 which is designed to mate with the outer peripheral mating surface 46 of cone 22. The outer peripheral mating surface 46 is disposed at an angle $\beta$ (beta) with respect to the axis 27 of cone 22 the axis 27 being parallel to the vertical movement of cone 22. As the cone 22 is forced downward, the outer peripheral surface 46 will mate with inner peripheral surface 44 of annular segments 38 thereby causing the outer peripheral surface 41 of segments 38 to engage the inner surface 42 of bore 16.

Bias means 40 initially bias annular segments 38 against cone 22. In the particular embodiment illustrated bias means 40 includes an annular retaining ring 47 which has a plurality of openings 49 spaced about the circumference of retaining ring 47 at least one opening 49 being associated with each annular segment 38. Retaining ring 47 has a bottom surface 51 which is supported by surface 45 of table 12, a top surface 52 which supports the bottom surface 53 of the outer annular portion of annular segment 38 and a vertical surface 55 which abutts vertical surface 57 of table 12. Bias means 40 also includes a spring 59 associated with each opening 49 which abutts against the inner vertical surface 61 of retaining ring 47 and is held in position by an associated bore 63 in annular segment 38. Bias means 40 further includes a retaining pin 65 having a shank 67 which is placed through opening 49 and spring 59, a threaded portion 69 which is threadly engaged in threaded opening 68 in annular segment 38 and a head portion 70 which is disposed in recess 71 in retaining ring 47. Recess 71 is larger than opening 49 and thus forms a shoulder 73 at their junction. Prior to the placement of workpiece 14 around expander assembly 20, bais means 40 applies a force against cone 22 such that cone 22 will cause annular segments 38 to move radially inward causing cone 22 to be moved upwards to that the workpiece can be easily positioned on table 12.

The apparatus 10 is further provided with an upper ram assembly 50 in column 15 which is capable of moving up and down to engage support table 12. The upper apparatus assembly 50 comprises a support structure 52 having an annular guard 54 attached at its lower end. The lower end 55 of guard 54 is designed to mate with the support table 12 so as to define a quenching chamber 56 when upper ram assembly 50 is lowered to engage support table 12. A gasket 57 is placed in a circular groove machined into support table 12 which forms a sealing relationship with the end 55 of guard 54. Secured to the upper support structure 52 is an inner annular die 58 and an outer annular die 59 which are designed to mate with the workpiece 14 as is commonly done in the prior art so as to provide appropriate pressure to help maintain the flatness of the workpiece 14 during quenching. Also secured to the support structure 52 is a ram 60 which is designed to mate with and apply a pressure to cone 22 of expander assembly 20. Ram 60 is appropriately connected to a source of hydraulic fluid capable of applying a substantially constant pressure against the cone. As the workpiece 14 cools, the bore 16 of workpiece 14 will become smaller thereby causing annular segments 38 to apply a force to the peripheral surface 46 of cone 22 which results in the cone 22 moving vertically upwards. The dies 58, 59 are connected to appropriate source of hydraulic fluid which provides a pressure as is well known in the prior art.

The upper end of ram 60 is connected to piston 62 within a chamber 63 formed in upper support structure 52. The upper portion 65 of chamber 63 above piston 62 is connected to an appropriate source of hydraulic fluid capable of applying pressure against piston 62. Balance grooves 66 are provided to keep piston 62 aligned and centered within the walls of chamber 63. Piston 62 is connected to a follower pin 68 which extends up through the upper support structure of upper ram assembly 50.

Figure 5:
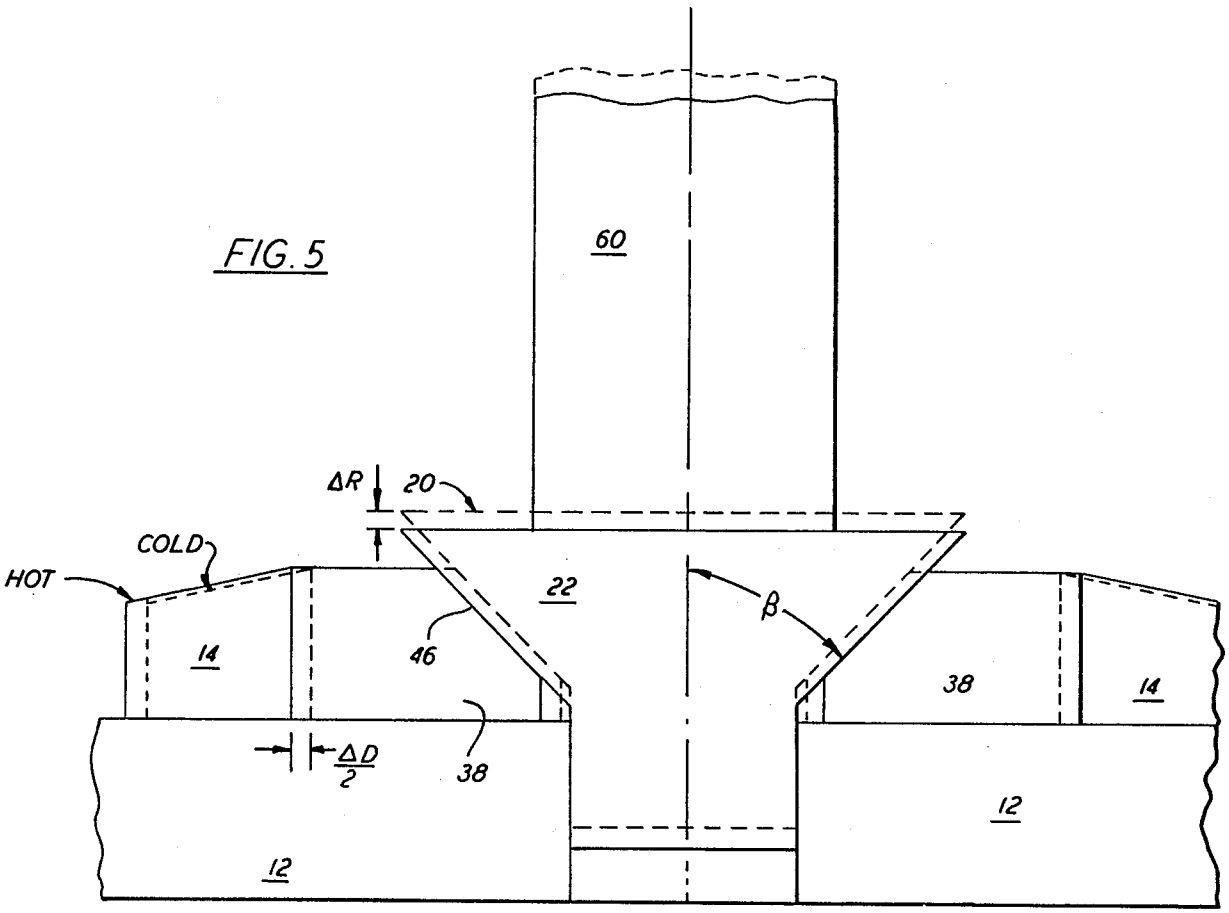
FIG. 5 is a diagramical representation illustrating how the change in the diameter of the workpiece is related to the change in displacement of the ram and expander assembly.

Referring to FIG. 5, there is illustrated a diagrammatic representation of how the expander assembly 20 and ram 60 move in response to the change in the size of the bore 16. The ram 60 applies a force to cone 22 which causes annular segments 38 to engage the workpiece 14. The solid lines indicate the relative position of the parts when a hot workpiece is initially placed on the expander assembly 20 and the dash lines indicate relative position of the parts after the workpiece 14 has cooled. The outer peripheral surface 46 of cone 22 is disposed at an angle (beta) relative to the longitudinal axis of the ram 60 which is parallel to the vertical displacement of ram 60.

The following relationship, equation no. 1, allows calculation of the change in diameter ($\Delta D$) of bore 16 in response to the movement of ram 60 ($\Delta R$):

(Equation no. 1)

$\Delta D = 2\Delta R \tan \beta$ wherein:

$\Delta D$ = change in workpiece diameter $\Delta R$ = movement of ram $\beta$ = mating angle between cone and annular segment of cone 22

Knowing the physical characteristics of the bore 16 of workpiece 14 after it has been machined and prior to its heat treatment and knowing the physical properties of the workpiece material, the temperature of the workpiece 14 can be readily calculated by using the following relationship:

(Equation no. 2)

$$T_x = \frac{\Delta D}{D \cdot K} + T_f$$

wherein:

K = coefficient of thermal expansion of the workpiece material.

D = inner diameter of the workpiece at room temperature $T_x$ = an elevated temperature of the workpiece to be determined by measuring the change in workpiece diameter.

$T_f$ = final temperature of workpiece at room temperature $\Delta D$ = change in workpiece diameter Referring back to FIG. 2, there is illustrated means in upper ram assembly 50 for measuring the position and relative movement of the ram in response to the size of bore 16 of workpiece 14. In the particular embodiment illustrated the measuring means comprises an electromechanical LVDT device 75 which produces an electrical output proportional to the displacement of a separable movable core therein. In the particular embodiment illustrated device 75 is pressfit in a recess 80 formed in upper support structure 52.

Figure 6:
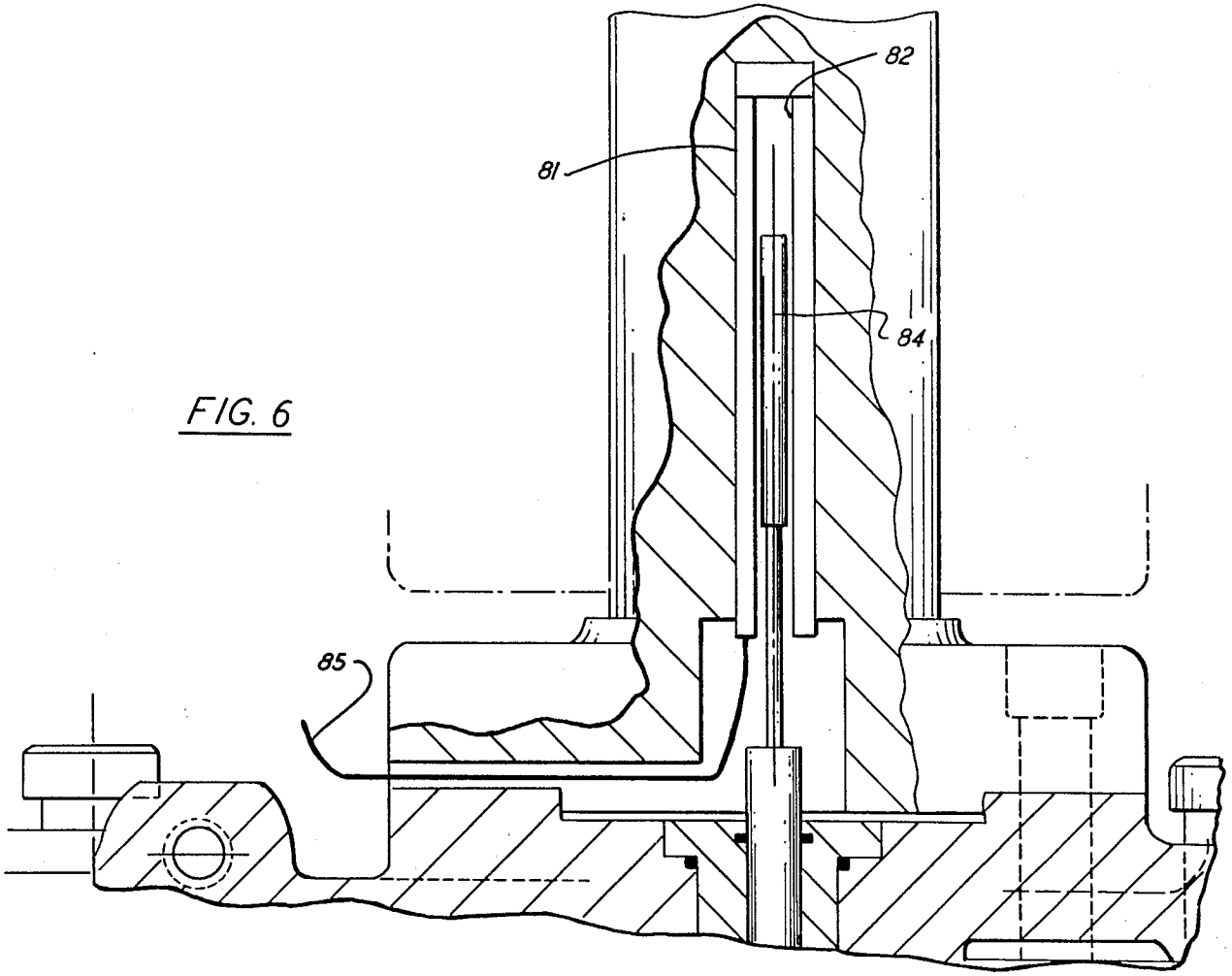
FIG. 6 is an enlarged fragmenting view of FIG. 2 illustrating the device for monitoring movement of the ram assembly.

Referring to FIG. 6, the device 75 comprises a primary coil housing 81 with a central bore 82. Disposed within bore 82 is a free moving rod shaped magnetic core 84. Disposed within bore 82 is a free moving rod shaped magnetic core 84. The primary coil housing 81 is energized by an external AC source voltage. When the core 84 is moved from a null position, induced voltages in a pair of adjoining secondary coils are generated in response to the movement of core 84. Depending on the movement of core 84, a plus or minus voltage will be generated. The output voltage is relayed to a microprocessor (not shown) through wire 85 in apparatus 10 for appropriate analysis to determine the position and/or amount of movement by core 84 as is well known in the art.

A typical electromechanical device 75 that can be used is device made by the Schaevitz Company, model no 400 AM. The Schaevitz device is particularly suitable for use with most quenching apparatuses on the market as most are now provided with microprocessors for controlling operation of the device. Therefore, by simply programing the appropriate information of the workpiece into the microprocessor, the apparatus 10 can monitor the bulk temperature of the workpiece. However, it should be understood that various other devices may be used for determining the actual displacement of the ram in response to the change in bore size.

In order to more fully understand the present invention, the operation of apparatus 20 will be described in more detail. Initially, the upper ram assembly 50 is raised to a nonengagement position with regard to the supporting table 12. At this time a workpiece 16, which is to be subjected to a quenching operation, is placed on the support table 12 and positioned such that the expander assembly 20 will fit within the bore 16 of the workpiece 14. Thereafter, support table is slid within column 15 and the upper ram assembly 50 is moved down into mating engagement with the support table 12 such that quenching chamber 56 is formed. At this point in time a quenching medium, typically oil, is brought into quenching chamber 56 as is typically done in prior art devices and is forced to pass around the workpiece 14 as illustrated by arrows in FIG. 2. During the quenching process the workpiece will continuously cool. When the upper ram assembly is in mating engagement with the support table, the ram 60 applies a force against cone 22 of expander assembly 20. This force on the ram provides constant contact with the cone. As workpiece 14 cools, the size of the bore 16 become smaller causing the cone 22 to be vertically displaced and thus move the ram 60 in the vertical direction. The measuring device 75 will provide an appropriate electrical signal to the microprocessor relaying the amount of displacement of ram 60. This infomation can be readily translated into the temperature of the workpiece. Since constant monitor of the displacement of ram 60 can be maintained, the temperature of the workpiece can also be constantly monitored thereby providing not only the initial temperature of the gear but the temperature at any given time during the quenching cycle. Once the appropriate temperature of the workpiece is reached, the flow of quenching medium may be stopped and the upper ram assembly 50 disengaged from the support table 12 to allow removal of the workpiece 14.

By monitoring the temperature directly from the workpiece, the workpiece may be removed from the chamber without concern that the temperature of the workpiece has not been reduced below the flash point of the quenching medium. If the workpiece can be cooled outside the quenching device without danger to the operator, the apparatus cycle can be terminated early thereby improving the productivity of the machine. Additionally, the present invention has the advantage of being able to control the hardness and toughness in the core material of the workpiece by controlling the rate at which the temperature is reduced. Further specific, repeatable properties can be obtained if a desired cooling rate is obtained and controlled. The obtaining of the appropriate hardness and toughness in the core of the workpiece is an important property for heavily loaded workpieces. Another important advantage of the present invention is that it allows monitoring the initial temperature of the part. Prior to the quenching process, it is important that the temperature of the workpiece be above the austenitizing temperature. If the part is not at the appropriate temperature, this can seriously affect the final material properties. This can be determined by the initial size of the bore 16 of workpiece 14 which can be readily translated to the temperature of the workpiece. This allows the operator to determine whether or not the furnace which has heated the workpiece has been properly adjusted or that the workpiece may be cooling too much prior to being provided to the quenching machine. Various other benefits can be attributed to being able to monitor the initial temperature of the workpiece and the rate of quenching.

It is to be understood by those skilled in the art that various modifications or changes can be made without departing from the scope of the present invention. For example, but not by way of limitation, other measuring devices may be used fo measuring the amount of vertical displacement of the ram 60. In the particular embodiment illustrated, a ram assembly and expander assembly are used to monitor the size of the bore 16, however, other means for monitoring the size of the bore of the workpiece may be utilized. Further other means may be used to calculate the temperature from the position of the ram and may even be manually calculated if so desired. The scope of the present invention being limited by the following claims.

What is claimed is:

1. In an apparatus for quenching a workpiece having a substantially circular central bore, said apparatus being of the type having:

a support table for supporting said workpiece;

an upper ram assembly capable of moving in and out of engagement with said support table, said upper ram assembly and support table defining a quenching chamber when in mating engagement;

an expander assembly for placement within said central bore of said workpiece, said expander being capable of transmitting a force against said bore;

means for applying a force against said expander assembly so as to cause the expander assembly to transmit a force against said bore, said means for applying a force against said expander assembly having a ram secured to said upper ram assembly, with said ram arranged to move in direct relationship to the change in size of said bore during quenching; and means for circulating a quench medium within said quenching chamber for quenching said workpiece; the improvement in said apparatus comprising means for measuring the temperature of said workpiece during quenching in response to the change in size of said bore, and wherein said means for measuring the temperature of said workpiece comprises a device for measuring the change in displacement of said ram during quenching.

2. An apparatus according to claim 1 wherein said means for measuring the change in displacement of said ram comprises an electromechanical device having a movable core, said electromechanical device being secured to said ram outside of said quenching chamber for producing an electrical output proportion to the displacement of said movable core.

3. An apparatus according to claim 2 wherein said apparatus further comprises a microprocessor for receiving said electrical output proportioned to the displacement of said movable core and calculating the temperature of the workpiece.

4. An apparatus according to claim 2 wherein said microprocessor calculates the temperature of said workpiece in accordance with the following relationship:

$$T_x = \frac{\Delta D}{D \cdot K} + T_f$$

wherein:

K = coefficient of thermal expansion of the workpiece material.

D = inner diameter of the workpiece at room temperature $T_x$ = an elevated temperature of the workpiece to be determined by measuring the change in workpiece diameter.

$T_f$ = final temperature of workpiece at room temperature $\Delta D$ = change in workpiece diameter.

* * * * *

UNITED STATES PATENT OFFICE

CERTIFICATE OF CORRECTION

PATENT NO. : 4,844,427

DATED : July 4, 1989

INVENTOR(S) : Harry Pedersen

It is certified that error appears in the above-identified patent and that said Letters Patent is hereby corrected as shown below:

In column 1, line 45, delete "intended" and substitute --invented--;

In column 2, line 49, delete "on" and substitute --in--;

In column 2, line 49, "on" (2nd) occurrence should read --of--;

In column 2, line 65, delete "tables" and substitute --table--;

In column 3, line 43, delete "upwards to" and substitute --upwards so--;

In column 5, line 6, delete "Disposed within bore 82 is a free moving rod shaped magnetic core 84.";

In column 5, line 20, delete "no 400" and substitute --no. 400--;

In column 5, line 32, delete "20" and substitute --10--;

In column 5, lines 59 and 60, delete "monitor" and substitute --monitoring--;

In column 6, line 39, delete "fo" and substitute --for--;

UNITED STATES PATENT AND TRADEMARK OFFICE

CERTIFICATE OF CORRECTION

PATENT NO. : 4,844,427

DATED : July 4, 1989

INVENTOR(S) : Harry Pedersen

It is certified that error appears in the above-identified patent and that said Letters Patent is hereby corrected as shown below:

In column 6, line 44, delete "Further other" and substitute --Further, other--.

Signed and Sealed this

Twenty-second Day of May, 1990

*Attest:*

HARRY F. MANBECK, JR.

*Attesting Officer*

*Commissioner of Patents and Trademarks*